US007094158B1

(12) United States Patent
Wheat

(10) Patent No.: US 7,094,158 B1
(45) Date of Patent: Aug. 22, 2006

(54) GOLF PUTTING PRACTICE DEVICE

(76) Inventor: Cleveland E. Wheat, 1419 Greenmont Ct., Reston, VA (US) 20190

( * ) Notice: Subject to any disclaimer, the term of this patent is extended or adjusted under 35 U.S.C. 154(b) by 0 days.

(21) Appl. No.: 11/126,780

(22) Filed: May 10, 2005

(51) Int. Cl.
*A63B 69/36* (2006.01)

(52) U.S. Cl. ..... 473/183; 473/191; 273/127 C; 273/129 V

(58) Field of Classification Search ..... 473/183, 473/191, 194, 431; 273/127 C, 129 V, 395, 273/396
See application file for complete search history.

(56) References Cited

U.S. PATENT DOCUMENTS 2,709,594 A * 5/1955 Brandell ..... 473/183
2,719,719 A * 10/1955 Sherwan ..... 473/183
2,991,083 A * 7/1961 Hartung ..... 473/182
3,365,199 A * 1/1968 Scholin et al. ..... 473/163
3,467,389 A * 9/1969 Pedersen et al. ..... 473/183
3,810,632 A * 5/1974 Brandell ..... 473/183
4,249,739 A * 2/1981 Brandell ..... 473/183
4,563,009 A * 1/1986 Nagasaki et al. ..... 473/183
5,174,574 A * 12/1992 Knox et al. ..... 473/183
5,342,053 A * 8/1994 Smith ..... 473/155
6,508,720 B1 * 1/2003 Wheat ..... 473/183

* cited by examiner

*Primary Examiner*—Mark S. Graham

(57) ABSTRACT

A compact, low profile golf putting practice apparatus includes a two-part flipper including a longitudinal flipping member and a coaxially mounted base section supporting the flipper member. A torsion spring pivots the flipper from its retracted position into an extended position whereby it propels a ball forwardly from a pocket area, and a powered retractor reversely pivots the flipper from its extended orientation into its retracted orientation. For safety, the two sections of the flipper are normally coupled together for movement as a unit by a resilient coupler which is capable of expanding temporarily when the flipper encounters an obstruction to its movement from the extended orientation to the retracted orientation.

11 Claims, 6 Drawing Sheets

GOLF PUTTING PRACTICE DEVICE

BACKGROUND OF THE INVENTION

This invention relates to golf putting practice devices and, more particularly, to golf putting practice devices of the type embodying a mechanism for kicking a ball back to the person making a putt thereinto.

Golf putting practice devices employing various ball return mechanisms mounted therein have been heretofore known in the art. One improvement over the prior art embodies a spring powered flipper device to return the ball, as demonstrated in U.S. Pat. No. 6,508,720. In operation, a motorized mechanism retracts a flipper device against the tension force of an elongated spring member and then releases it to rotate freely forwardly through the contracting force of the spring and, thereby, contact the ball forcefully and send it back to the person. The flipper is again retracted, through the power of the motorized mechanism, into the operational position for returning the next putt.

Although the embodiment of the aforementioned patent results in a putt return device significantly smaller than that of prior art, the profile of the housing and the attached ball tray provide a limited target for putting practice. Also, the amount of torque generated by the motorized mechanism to retract the flipper is sufficient to cause injury if the user's finger is accidentally placed between the flipper and the housing during retraction. It is a primary object of the present invention to afford novel improvements over the golf putting practice devices heretofore known in the art.

One of the primary objects of the present invention is to afford a novel putting practice device that incorporates a two-part flipper device resiliently connected between a flipper section and supporting base section by a resilient means in a manner that allows the flipper portion to stop if obstructed by an object while retracting, thus preventing injury to the user or damage to the device.

A further object of the present invention is to afford a novel golf putting practice device with a lower profile and larger ball receiving tray to provide an improved, more realistic putting target.

Another object of the present invention is to afford a novel golf putting practice device, which embodies a flipper device of a substantially reduced size and a coaxially mounted torsion spring, constituted and arranged in a novel manner inside the device for returning a ball putted therein.

Yet another object of the present invention is to afford a novel golf putting practice device with a flipper apparatus that consistently returns a ball in a path perpendicular to the front of the device in a more efficient manner.

Another object of the present invention is to afford a novel golf putting practice device that can use either DC or AC power for operation.

Yet another object of the present invention is to afford a novel golf putting practice device with a means for monitoring battery power to the device and for indicating when battery replacement is necessary.

Another object of the present invention is to afford a novel golf putting practice device with a means to automatically shutoff power to the device after a set period of time of inactivity to conserve battery power.

A further object of the present invention is to afford a novel golf putting practice device which is practical and efficient in construction and operation, and which may be more readily and economically produced commercially.

Other and further objects of the present invention will be apparent from the following description and claims and are illustrated in the accompanying drawings, which, by way of illustration, show a preferred embodiment of the present invention and the principles thereof and what is to be considered the best mode in which to apply these principles. Other embodiments of the invention embodying the same or equivalent principles may be used and structural changes may be made as desired by those skilled in the art without departing from the present invention and the purview of the appended claims.

SUMMARY OF THE INVENTION

The present invention provides a golf putting practice apparatus with a housing and ball tray for receiving a golf ball putted therein. The invention is particularly characterized by a ball return mechanism comprised of a two-part flipper apparatus, resiliently connected between the flipper and base sections and having a torsion spring coaxially mounted and engaging the base section of the flipper resiliently for ejecting a ball from the ball tray. The flipper apparatus affords safe operation during the retraction of the flipper and prevents accidental injury to the user or damage to the device if the flipper is engaged, obstructively, while retracting into the operational position at the rear of the ball tray. This invention incorporates a means to automatically deactivate the device after a set period of inactivity to preserve battery power, and provides an adaptor means to use a/c power for operation.

The present invention affords novel safety means as well as reduced spatial requirements over the prior art. The size reduction of the housing portion results in a device with a lower profile, larger ball tray for putting practice, increased portability, and an overall more realistic putting target.

BRIEF DESCRIPTION OF THE DRAWING

The above and related objects, features and advantages of the present invention will be more fully understood by reference to the following detailed description of the presently preferred, albeit illustrative, embodiments when taken in conjunction with the accompanying drawing wherein.

REFERENCE NUMERALS IN DRAWINGS

Figure 1:
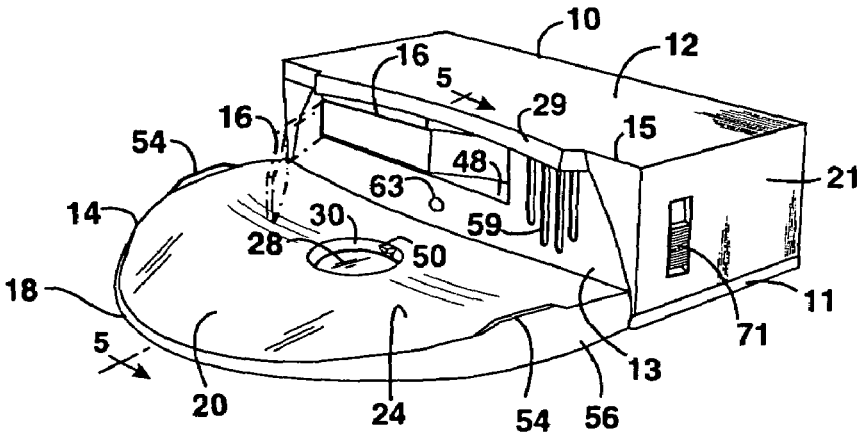
FIG. 1 is the front perspective view of a golf putting practice device embodying the principles of the present invention.

| | | | |
|---|---|---|---|
| 10 | putting practice device | 11 | base |
| 12 | main housing | 13 | front wall |
| 14 | ball tray | 15 | top edge |
| 16 | flipper device | 17 | front face |
| 18 | front edge | 19 | rear wall |
| 20 | front ramp | 21 | side wall |
| 22 | rear edge | 23 | opening |
| 24 | floor | 26 | side edge |
| 28 | ball pocket | 29 | bumper |
| 30 | interior wall | 31 | axle |
| 32 | axle | 33 | battery box |
| 34 | drive wheel | 35 | battery box door |
| 36 | pivot arm | 37 | reduction gear members |
| 38 | torsion spring | 39 | pivot pin |
| 40 | flipper section | 41 | flipper base |
| 42 | axle sleeve | 43 | brake |
| 44 | resilient connector | 45 | axle sleeve |
| 46 | end extension | 47 | spring cavity |
| 48 | longitudinal cavity | 49 | free end |
| 50 | lever switch | 51 | leaf switch |
| 52 | ball | 53 | leaf switch |
| 54 | side rib | 55 | rotating arm |
| 56 | side wall | 57 | power arm |
| 58 | speaker | 59 | speaker grille |
| 60 | microprocessor | 61 | fin |
| 62 | audio amplifier | 63 | light emitting diode |
| 64 | electric socket | 65 | stop |
| 66 | motor | 68 | pivot plate |
| 70 | power supply | 71 | main switch |
| 72 | battery meter | 74 | object |

DETAILED DESCRIPTION OF THE PREFERRED EMBODIMENTS

A game device in the form of a golf putting practice device 10, embodying the principles of the present invention, is shown in FIGS. 1–11, inclusive, of the drawings to illustrate the presently preferred embodiment of the present invention.

The golf putting practice device 10 is of the same general type as shown in the heretofore mentioned U.S. Pat. No. 6,508,720 and embodies in general, a housing 12, a base 11, a ball tray 14 into which a golf ball may be putted, a flipper device 16 disposed in an operative position in the housing 12 for returning the ball from the ball tray 14 to the person making the putt, and a microprocessor 60 that controls the electronic functions of the device 10.

In the use of the device 10, a ball is putted from a position in front thereof upwardly across the front ramp 20 into the ball tray 14 and rolls by gravity downwardly across the floor 24 into the ball pocket 28 from which it is ejected forwardly from the device 10 by the flipper device 16 while a simultaneously produced sound effect is emitted as positive feedback for the successful putt.

Figure 2:
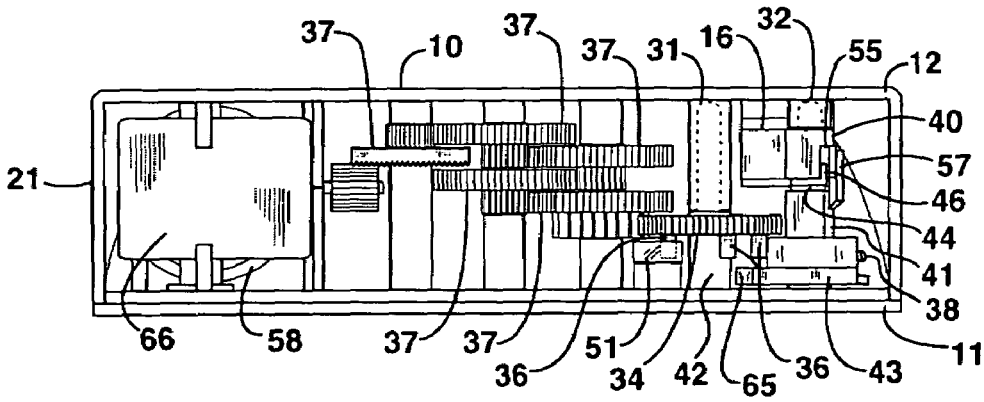
FIG. 2 is a longitudinal section view taken considerably along the line 2—2 of FIG. 3.
Figure 3:
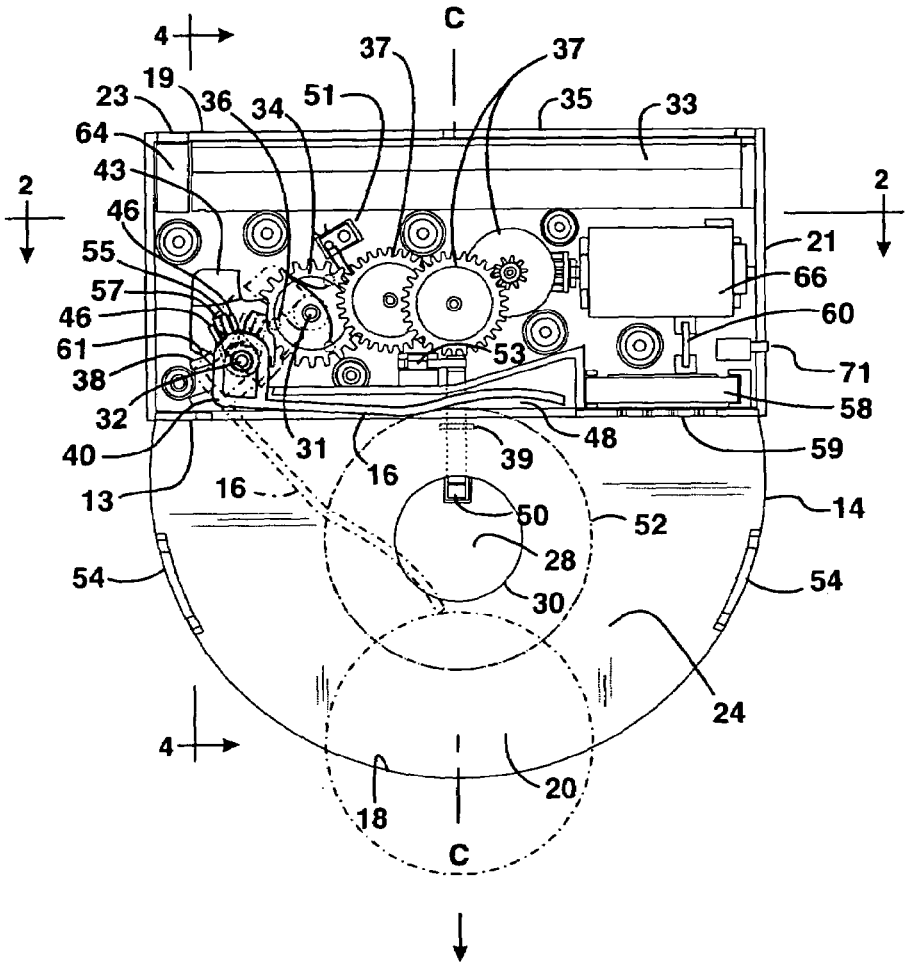
FIG. 3 is a top sectional view.
Figure 4:
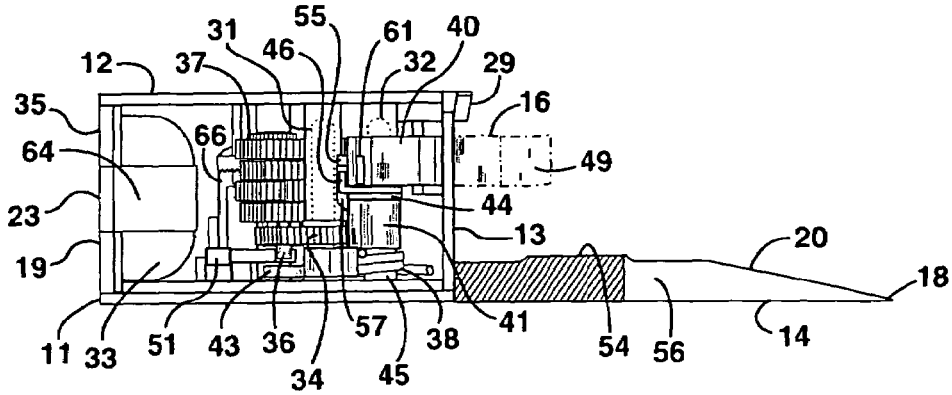
FIG. 4 is a longitudinal section view taken considerably along line 4—4 of FIG. 3.

The present invention contains a novel, two-part flipper device 16, as shown in detail in FIG. 6, FIG. 7, FIG. 8, and FIG. 9, that is comprised of a flipper section 40, which embodies a longitudinal planar member mounted for movement relative to the ball tray 14, and a supporting flipper base 41. Referring to FIG. 2 and FIG. 4, the flipper device 16 is connected pivotally between the base 11 of the device 10 and the top of the housing 12 by the axle 32 passing throughout and providing a vertical axis about which the flipper device 16 may pivot horizontally relative to the base 11 and housing 12 from a retracted position, preferably substantially along the rear of the ball tray 14, as shown in solid lines in FIGS. 1 and 3–4, to a released position extending across a portion of the ball tray 14, as depicted by broken lines in the same figures.

Figure 9:
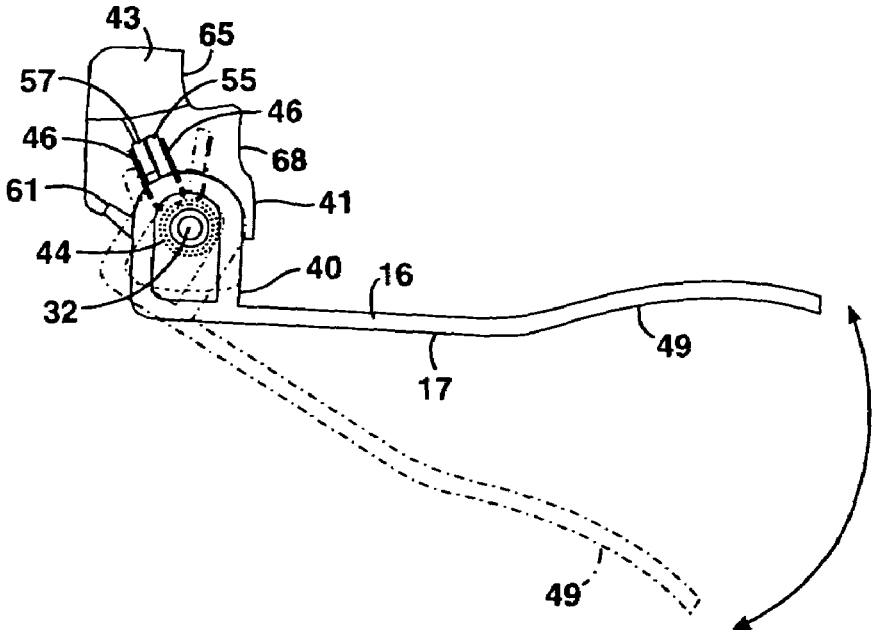
FIG. 9 is a top view of the flipper device.

The two sections 40, 41 of the flipper device 16 are resiliently connected by the coaxially mounted resilient connector 44. The flipper base 41 provides the rotational energy that turns the flipper section 40 through the connection at the power arm 57 of the base and the rotating arm 55 of the flipper. The two arms 55, 57 are normally bonded together by the force of the two end extensions 46 of the resilient connector 44, thereby causing the two sections 40, 41 to rotate in unison. Referring now to FIG. 9, the resilient expandability of the resilient connector 44 releases the rotational force at the flipper section 40 so that its rearward movement stops if obstructed while retracting, as shown in broken lines, thus preventing injury or damage. This allows the flipper base 41 to rotate independently through the engagement with the motorized means and, thereby, interrupt power to the motor 66 when the rotation cycle is complete. The flipper section 40 also embodies a fin 61, as shown in FIGS. 3 and 4 and further detailed in FIG. 10C, that engages the power arm 57 of the flipper base 41, obstructively, at the point of maximum rotation of the flipper section 40 in relation to the flipper base 41.

Figure 7:
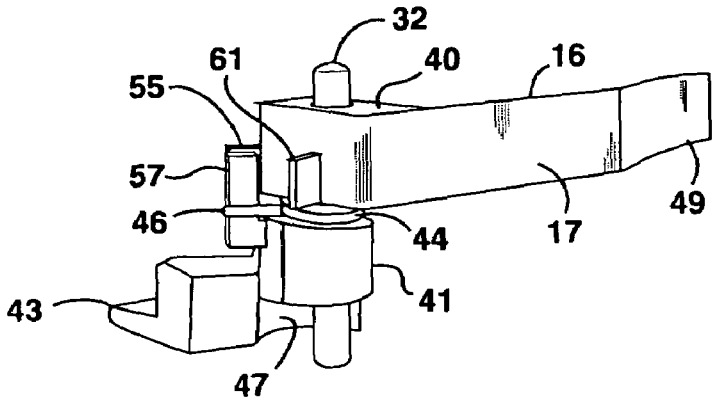
FIG. 7 is a frontal perspective view of the flipper device.
Figure 8:
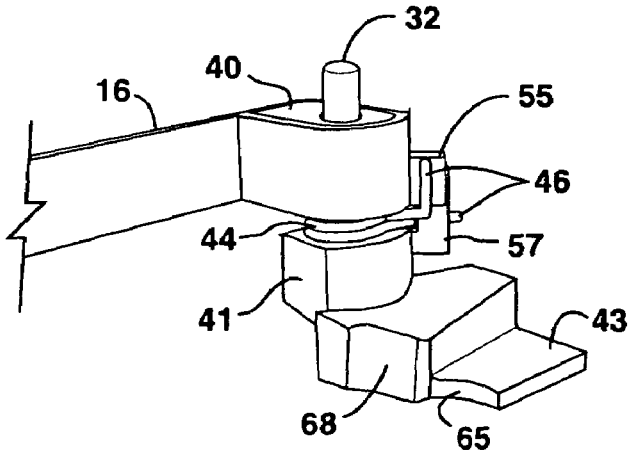
FIG. 8 is a fragmentary rear perspective view of the flipper device.

Referring to FIG. 7 and FIG. 9, the free end 49 of the flipper device 16 is fashioned in a rearward direction in such a manner as to form a reflex angle at the intersection of the free end 49 and front face 17. Referring to FIG. 3, the resulting configuration directs the ball 52 in a substantially straight-line trajectory when ejected from the ball pocket 28 of ball tray 14 through the forward rotation of the flipper 16.

The flipper base 41 also contains the pivot plate 68 and the brake 43. The pivot plate 68 engages the pivot arm 36 of the adjacently disposed drive wheel 34 during rotation about the axle 31, as shown in FIG. 2 and FIG. 3, and further detailed in FIG. 10A and FIG. 10B. Referring again to FIG. 8, a recessed section of the leading edge of the brake 43 forms a stop 65 member that halts the forward rotation of the flipper device 16, after release from connection with the drive wheel 34, by engaging the axle sleeve 42 of the drive wheel 34, obstructively, as shown in FIG. 3 and further detailed in FIG. 10B.

Figure 6:
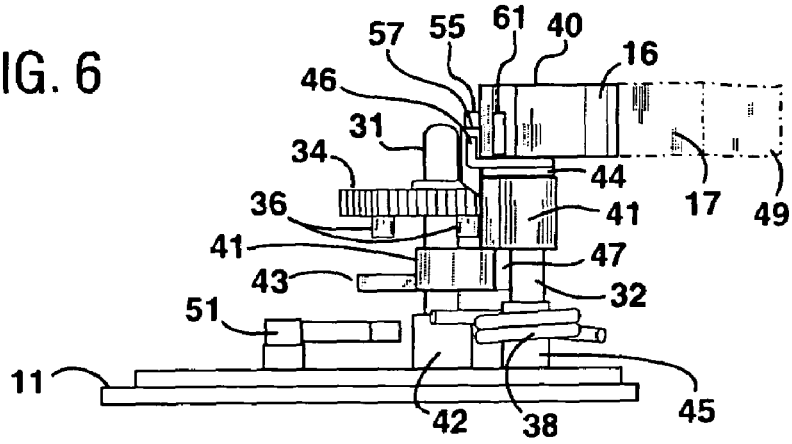
FIG. 6 is an exploded view of the flipper device and torque spring as shown in FIG. 2, FIG. 3, and FIG. 4.

The torsion spring 38 engages the flipper base 41 at the spring cavity 47 and around the axle sleeve 45 and axle 32, as shown in FIG. 4 and FIG. 6, and produces a novel arrangement which provides the required rotational energy to pivot the flipper device 16 forwardly in the ball return operation. The torsion spring 38 further engages the interior surface of the device 10, obstructively, which prevents rotation of the spring 38 during the retraction and release of the flipper 16.

The flipper device 16 is pivoted in a rearward direction through the connection with the drive wheel 34, which is comprised of a gear wheel having a plurality of protruding pivot arms 36 that extend downward from underneath. The pivot arms 36 are constructed and arranged to engage the flipper device 16 and leaf switch 51 in such a manner as to open the normally closed switch 51 to interrupt the power to the motor 66 when the flipper device 16 is in the normally retracted operative position, as shown in FIG. 2 and FIG. 3, and further detailed in FIG. 10A.

The drive wheel 34 is coupled, through a mechanical means comprised of a plurality of reduction gear members 37, to the motor 66 mounted to the base 11 of the device 10. The flipper device 16 is normally positioned in the retreated position inside the face of the housing 12 by the rotation of the drive wheel 34 through the power of the motorized mechanical means. As the drive wheel 34 rotates, the pivot arm 36 closest to the pivot plate 68 of the base 41 of the flipper 16 engages the base 41 at the intersection of the pivot arm 36 with the pivot plate 68. Continued rotation of the drive gear 34 pivotally retracts the flipper device 16 from the released extended position and retains the flipper 16, against the resilient force of the torsion spring 38, in the retracted operative position along the rear face of the ball tray 14, as shown in solid lines in FIG. 1 and FIG. 3.

Figure 10A:
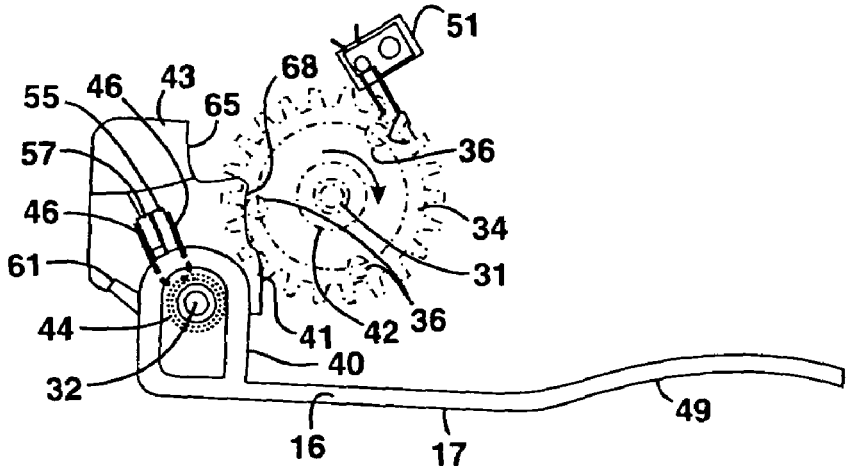
FIG. 10A is a top view of the flipper device in the retracted position with the drive wheel shown in FIG. 2.

FIG. 10A further illustrates the flipper device 16 in the retracted position through the engagement with the drive wheel 34 at the intersection of the pivot arm 36 with the pivot plate 68 of the flipper base 41. A second pivot arm 36 is located in a forward position on the drive wheel 34 in relation to the engaged pivot arm 36 and, simultaneously, engages the normally closed leaf switch 51, thereby opening the switch and interrupting power to the motor 66. This halts the rotation of the drive wheel 34 at the connection of the engaged pivot arm 36 with the flipper base 41 and, subsequently, maintains the flipper device 14 in the retracted position through the inertia of the gear drive assembly.

Figure 10B:
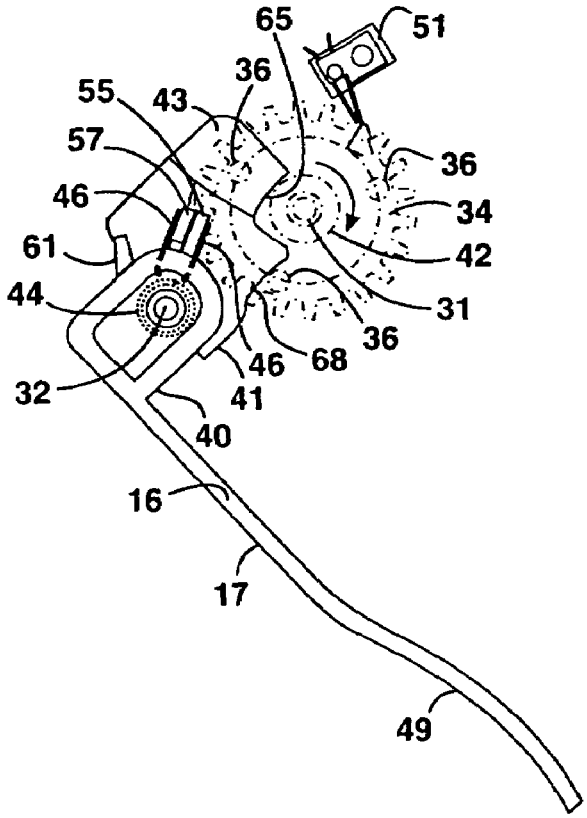
FIG. 10B is a top view of the flipper device in the released position with the drive wheel shown in FIG. 2.

FIG. 10B shows the flipper device 16 in released position after power to the motor 66 has been restored and the subsequent rotation of the gear wheel 34 has moved both pivot arms 36 out of connective engagement with the flipper base 41 and leaf switch 51, simultaneously. This allows the flipper device 16 to pivot forward freely through the force of the torsion spring 38 to the released position.

Figure 10C:
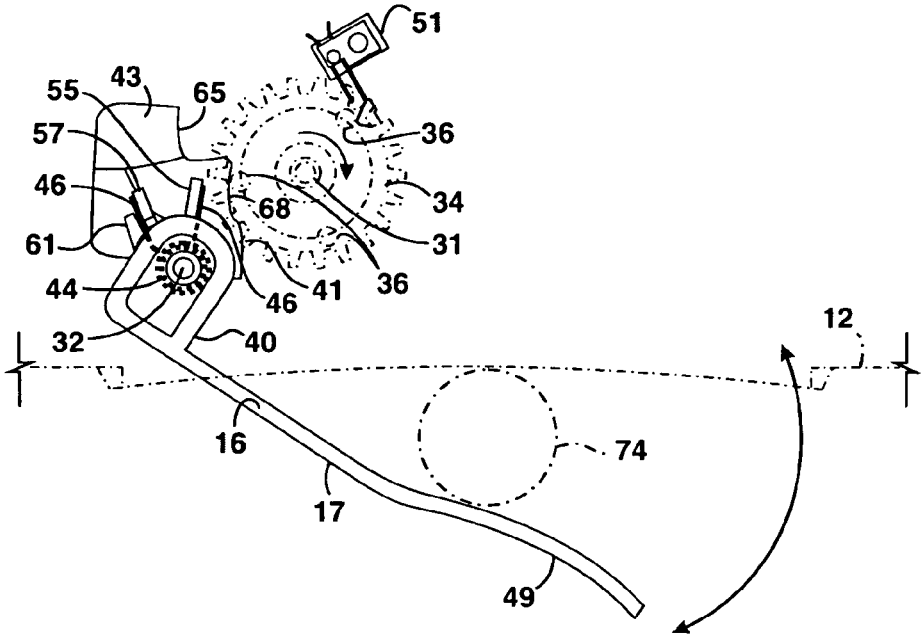
FIG. 10C is a top view of the flipper device when obstructed by an object while retracting.

FIG. 10C shows the rearward movement of the flipper section 40 of the flipper device 16 halted by an object 74 obstructing its path while retracting into the front of the housing 12 (indicated in broken lines). The continuing rotation of the flipper base 41, through engagement with the drive wheel 34 at the intersection of the engaged pivot arm 36 with the pivot plate 68, forces the end extension 46 of the resilient connector 44 to expand. This releases the connection of the flipper base 41 and flipper section 40 at the union of the power arm 57 with the rotating arm 55, thus allowing the flipper base 41 to continue rotating until fully retracted. The second pivot arm 36 further engages the normally closed leaf switch 51, causing the switch to open and disrupt power to the motor 66, thereby retaining the flipper base 41 in the retracted position through the inertia of the gear drive assembly.

Referring to FIG. 1, FIG. 3, and FIG. 4, the present invention also contains a novel ball tray 14 with a substantially open perimeter and embodies a front ramp 20, which slopes upwardly and rearwardly from the front edge 18 of the ball tray 14 to the floor 24 that slopes downwardly from all sides to the ball pocket 28 and terminates at the front wall 13 of the housing 12. The front entrance to the ball tray 14 forms an arc in likeness to the entrance to a regulation putting cup and is connected at each end to the side wall 56 to form the putting target.

The ball tray 14 embodies side rib 54 members comprised of a vertical projection of a portion of the wall at each side of the ball tray 14 in a manner to retain the ball 52 traveling into the interior of the ball tray 14, unless said ball is directed thereto at excessive speed.

The ball pocket 28 is located along the central axis C of the ball tray 14, as shown in FIG. 3, and consists of a recess in the floor 24 of the ball tray 14, preferably sized to snugly, yet freely, receive, and of sufficient depth to trap, a standard size golf ball therein in a secure and stable manner in a position adjacent to the front of the retracted flipper section 40. Further, referring to FIG. 5, the device 10 contains a lever switch 50, one end of which terminates adjacent to the leaf switch 53 and the other end terminates at the interior wall 30 of the ball pocket 28, and protrudes therein only far enough to operationally engage the circumference and weight of the ball 52 therein.

The lever switch 50 is comprised of a horizontal planar member embodying pivot pins 39 on either side thereof as fulcrums. When mounted in the device 10, this allows pivotal movement of the lever switch 50 when engaged by the ball 52 in the ball pocket 28. Consequently, the downward force on the ball pocket end of the lever switch 50 causes the opposite end to move in a corresponding upward direction which, thereby, engages and closes the normally open leaf switch 53, as shown by broken lines in FIG. 5.

Figure 5:
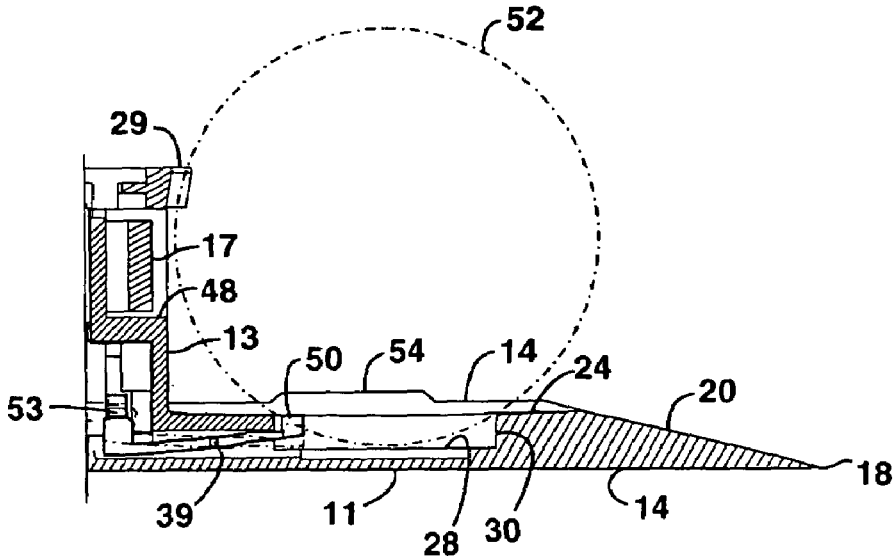
FIG. 5 is a sectional view taken generally along line 5—5 of FIG. 1.

The device 10 contains a novel housing 12, as shown in FIG. 1, FIG. 4, and FIG. 5, that incorporates a ball bumper 29 consisting of a projected overhang along the front edge to engage a ball at the rear of the ball tray 14 and, thereby, reduce rebounding of the ball 52 entering the ball tray 14, and further guide the ball into the ball pocket 28. Referring further to FIG. 1, FIG. 3 and FIG. 5, the front wall 13 of the housing 12 contains a longitudinal cavity 48 to accommodate the flipper section 40 of the flipper device 16 when retracted into the operative position. The device 10 also incorporates a speaker grille 59 in the front wall 13 that provides pathways for the emission of audible sounds from the speaker 58 located adjacent thereto. Power to the device 10 is controlled through the operation of the main switch 71 located in the side wall 21 of the housing 12 and attached, switchably, to a power control means.

Figure 11:
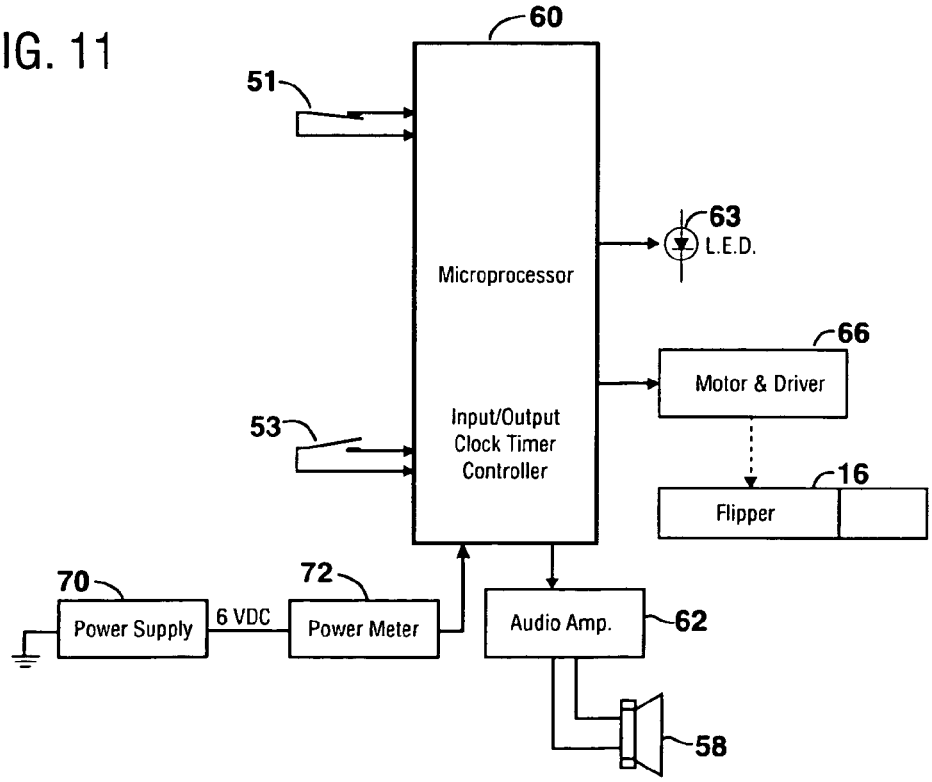
FIG. 11 is a block diagram of the electronic control system of the device.

Referring now to FIG. 11 in particularly, the device 10 incorporates a microprocessor 60 to control the operating functions of the components. The leaf switch 53 activates the microprocessor 60 when engaged by the lever switch 50 through contact with the ball 52 in the ball pocket 28. This restores power to the motor 66 and, simultaneously, generates one of a plurality of audio sound effects, selected randomly, through the operation of the audio amp 62 and the speaker 58.

The microprocessor 60 embodies a means to detect if the power falls below a determined threshold for operation and a flashing means that engages the light emitting diode 63 mounted in the housing 12, electrically, in a blinking pattern to indicate the battery components must be replaced. If replacement is not completed within the set time limit, the microprocessor 60 activates a means to automatically shut-off power to the device 10 to prevent improper operation. The microprocessor 60 also turns off power to the device 10 if the mechanism is not activated within a set a time period to conserve battery life.

FIG. 11 illustrates in block diagram form the control system for the device 10. The system is energized through the power supply 70 which is monitored through the power meter 72. The main control component is a microprocessor 60 that receives input signals from the leaf switches 51 and 53. The microprocessor controls the on/off function of the motor through block 66, the light emitting diode functions through LED 63, and the sound effects through the audio amplifier 62 and the speaker 58.

Referring to FIG. 3 and FIG. 4, the device 10 contains an opening 23 in the rear wall 19 to an electric socket 64 disposed in the rear of the housing 12 adjacent to the battery box 33. An AC adapter can be plugged into the electric socket 64 to transmit electric power of the proper voltage to operate the device 10. The insertion of the plug into the electric socket 64 disconnects the power from the battery box 33 to the motorized mechanism and further provides, through the connection, commercial electrical power for operation.

The operation of the putting practice device according to the present invention shall be described next as summarized. Referring to FIG. 1, FIG. 3, and FIG. 5, a ball 52 enters the device 10 at the front edge 18 and rolls upwardly across the front ramp 20 and downwardly by gravity across the floor 24 of the ball tray 14 and contacts the bumper 29 which deflects the impact and guides the ball 52 to rest in the ball pocket 28. The circumference and weight of the ball 52 engages the lever switch 50 and forces the end of the lever to pivot about the pivot pin 39 in a downward manner, as shown by broken lines in FIG. 5. Consequently, the opposite end of the lever switch 50 pivots in a corresponding upward direction and engages the leaf switch 53 in such a manner as to move the switch from the normally open position, shown by solid lines, to a closed position, as shown by broken lines. This sends a signal to the microprocessor 60, which temporarily restores power to the motor 66 and, simultaneously, generates a random sound effect through the operation of the audio amp 62 and the speaker 58 located behind the speaker grille 59.

The activation of the motor 66 causes, through connective engagement to the mechanical means, the drive wheel 34 to rotate and move the conjoined pivot arm 36 out of a connective position with the flipper base 41, thereby releasing the retracted flipper device 16 to pivot forward freely through the rotational energy of the torsion spring 38 until halted through contact of the stop 65 of the brake 43 with the axle sleeve 42, obstructively. The force of the forwardly moving flipper 16 ejects the ball 52 from the ball pocket 28 and sends it back to the person making the putt.

The subsequent rotation of the drive wheel 34 advances a succeeding pivot arm 36 into an engaged position with the pivot plate 68 of the flipper base 41 and thereby rotates the flipper device 16 in a rearwardly direction against the resilient force of the torsion spring 38 until the forwardly advancing pivot arm 36 (trailing the engaged pivot arm 36) engages the leaf switch 51. This interrupts power to the motor 66, consequently halting and retaining the flipper device 16 in the retracted operative position inside the housing 12 along the rear of the ball tray 14 and ready to return the next putt.

If during operation the flipper section 40 is obstructed by an object 74 while retracting, the resistance causes the resilient connector 44 to expand, thereby releasing the flipper section 40 from the retracting force of the motorized mechanism and halting its rearward motion while the flipper base 41 continues rotation and automatically interrupts power to the motor 66 by opening switch 51. Further, the resilience of the connection of the flipper section 40 to the base section 41 allows an object 74 to be easily removed by manually pivoting the flipper device 16 slightly forward until the object is dislodged.

From the foregoing, it will be seen that the present invention affords a novel golf putting practice device that embodies a novel two-part flipper apparatus to provide safe operation during retraction of the flipper. Further, the coaxially mounted torsion spring member engages the flipper device at the base section to provide the rotational energy for the ball return function. This arrangement requires a minimum amount of space to house the ball return mechanism. The resulting lower profile of the housing and the larger ball tray receiving area afford an improved and more accurate target for putting practice.

Next, it will be seen that the present invention provides a novel housing that incorporates a bumper that contacts the ball along the rear of the ball tray to reduce rebounding of the ball entering therein and further guide the ball into the ball pocket.

Further, it will be seen that the present invention provides a novel putting practice device that embodies an automatic timing mechanism to turn off power to the device if the device is not operated within a set period of time to conserve battery power.

It will also be seen that the present invention affords a novel putting practice device that is extremely portable, practical and efficient in construction and operation, and is more readily and economically produced commercially.

Yet further, it will be seen that the present invention affords a novel putting practice device with a means to measure battery power and cause the light emitting diode to operate in a blinking fashion if the power drops below a determined operating value. In addition, the same means automatically deactivates the device if the power remains below the minimum operating value for a predetermined amount of time.

It will also be seen that the present invention affords a novel putting practice device that can use either DC or AC current for operation.

While the present invention has been shown and described herein in connection with a golf ball, it will be readily apparent to those skilled in the art that the principles of the present invention may be used in connection with any ball-return practice apparatus (for example, one used with a soccer ball or a billard/pool ball), thereby to test the accuracy of a player's driving of the ball relative to a designated target and an automatic return of the ball to or adjacent to its point of origin. Of course, the ball-return practice device would be adjusted in its configuration and dimensions relative to the dimensions of the ball.

Thus, from the illustration and description of the preferred embodiment of the present invention, it is to be understood that many possible embodiments may be made of the invention without departing from the scope thereof, and that all matter herein set forth or shown is to be interpreted as illustrative and not in a limiting sense.

I claim:

1. A golf putting practice apparatus comprising:

(A) base and housing members;

(B) a ball tray extending forwardly from said base and housing members and defining on its upper surface a depressed pocket area for receiving a ball;

(C) flipper means including a longitudinal flipper member and a coaxially mounted base section supporting said flipper member;

(D) means for mounting said flipper means for pivotal movement between its retracted orientation wherein said flipper member is substantially behind said pocket area and its extended orientation wherein said flipper member is at least over a portion of said ball tray;

(E) rotational energy storage means for pivoting said flipper means from its retracted orientation into its extended orientation whereby said flipper member propels a ball forwardly from said pocket area;

(F) powered retractor means for pivoting said flipper means, after propelling a ball forwardly from said pocket area, from its extended orientation into its retracted orientation; and (G) means for powering said retractor means.

2. The apparatus of claim 1, wherein said flipper means additionally includes means for releasably engaging said flipper member and said base section with each other to transfer pivotal movement therebetween.

3. The apparatus of claim 2, wherein said engaging means has a coaxially mounted resilient connector to bind said flipper member and said base section together for providing pivoting as a unit unless said flipper member is engaged obstructively by an object during retraction, thereby causing said resilient connector to release said base section and said flipper member to pivot independently.

4. The apparatus of claim 3 wherein said flipper member and base section are normally connected for movement as a unit through the force exerted by said resilient connector.

5. The apparatus of claim 1, wherein said rotational energy storage means is a torsion spring member coaxially mounted about a vertical axis and engaging said base section to provide a rotational force to pivot said flipper means.

6. The apparatus of claim 5, wherein said retractor means includes a rotating element connected to said power means and engaging said base section to pivot said base section and, consequently, said flipper member in response to rotation of said rotating element, thereby reversely pivoting said flipper means against the resilient force of said torsion spring member.

7. The apparatus of claim 6, wherein said power means includes an electric motor connected to said rotating element to provide rotational energy to said retractor means.

8. The apparatus of claim 1, wherein said housing includes a projecting overhang at the front edge thereof, along the rear of said ball tray, to guide a ball encountering said overhang towards said pocket area.

9. The apparatus of claim 1, wherein said apparatus includes:

(H) microprocessor for controlling the power to an electric motor of said retractor means and continuously monitoring the operating voltage to said apparatus; said microprocessor including timing means for automatically deactivating power to said apparatus if said apparatus is not activated within a predetermined time period, or if the operating voltage remains below a preset threshold for a determined period of time; and (I) signal means responsive to said timing means.

10. The apparatus of claim 1 wherein said mounting means mounts said flipper means for substantially horizontal movement about a substantially vertical axis.

11. A ball-return practice apparatus comprising:

(A) base and housing members;

(B) ball tray extending forwardly from said base and housing members and defining on its upper surface a depressed pocket area for receiving a ball;

(C) flipper means including a longitudinal flipper member and a coaxially mounted base section supporting said flipper member, said flipper means additionally including means for releasably engaging said flipper member and said base section with each other to transfer pivotal movement therebetween, said engaging means having a coaxially mounted resilient connector to bind said flipper member and said base section together for providing pivoting as a unit through the force exerted by said resilient connector unless said flipper member is engaged obstructively by an object during retraction, thereby causing said resilient connector to release said base section and said flipper member to pivot independently;

(D) means for mounting said flipper means for pivotal movement between its retracted orientation wherein said flipper member is substantially behind said pocket area and its extended orientation wherein said flipper member is at least over a portion of said ball tray, said mounting means mounting said flipper means for substantially horizontal movement about a substantially vertical axis;

(E) rotational energy storage means for pivoting said flipper means from its retracted orientation into its extended orientation whereby said flipper member propels a ball forwardly from said pocket area, said rotational energy storage means being a torsion spring member coaxially mounted about the vertical axis and engaging said base section to provide a rotation force to pivot said flipper means;

(F) powered retractor means for pivoting said flipper means, after propelling a ball forwardly from said pocket area, from its extended orientation into its retracted orientation, said powered retractor means including a rotating element connected to said power means and engaging said base section to pivot said base section and, consequently, said flipper member in response to rotation of said rotating element, thereby reversely pivoting said flipper means against the resilient force of said torsion spring member; and (G) means for powering said retractor means said power means including an electric motor connected to said rotating element to provide rotational energy to said retractor means.

* * * * *